United States Patent [19]

Ritland

[11] Patent Number: 4,655,013

[45] Date of Patent: Apr. 7, 1987

[54] PREFABRICATED MODULAR BUILDING AND METHOD OF ASSEMBLY

[76] Inventor: Norman A. Ritland, 7262 Black Hill Rd., Lodi, Wis. 53555

[21] Appl. No.: 696,574

[22] Filed: Jan. 30, 1985

[51] Int. Cl.[4] ..... E04B 1/32

[52] U.S. Cl. ..... 52/80; 52/82; 52/127.9; 52/595

[58] Field of Search ..... 52/80, 81, 82, 86, 582, 52/595, 127.9

[56] References Cited

U.S. PATENT DOCUMENTS

| | | | |
|---|---|---|---|
| 3,400,958 | 9/1968 | Haimes et al. | 52/127.9 |
| 3,562,975 | 2/1971 | Moss | 52/80 |
| 3,671,006 | 6/1972 | Berkowitz | 52/127.9 |
| 3,763,608 | 10/1973 | Chamlee | 52/80 |
| 3,785,103 | 1/1974 | Turner | 52/127.9 X |
| 3,999,337 | 12/1976 | Tomassetti et al. | 52/82 |
| 4,023,317 | 5/1977 | Bettger et al. | 52/80 |
| 4,044,511 | 8/1977 | Lingle | 52/127.9 |
| 4,068,437 | 1/1978 | Byxbe et al. | 52/82 |

FOREIGN PATENT DOCUMENTS

| | | | |
|---|---|---|---|
| 625089 | 9/1961 | Italy | 52/80 |

*Primary Examiner*—J. Karl Bell

*Attorney, Agent, or Firm*—Shlesinger, Arkwright, Garvey & Fado

[57] ABSTRACT

A prefabricated modular building includes a plurality of lightweight contoured panels which are interconnected. Each of the panels has arcuate top, bottom and side edges so that the panels provide identically sized and contoured segments of an oblate spheroid. A securement mechanism is associated with each of the side edges of the panels and the securement mechanism of adjacent panels are interengaged for securing the panels together. The top edges cooperate and define a circular opening of substantial diameter. A fastening mechanism is associated with the top edge of each of the panels and a compression ring is cooperatively engaged with the fastening system of each of the panels for positively accurately positioning and aligning the panels and for thereby providing a rigid structure.

23 Claims, 9 Drawing Figures

FIG 8
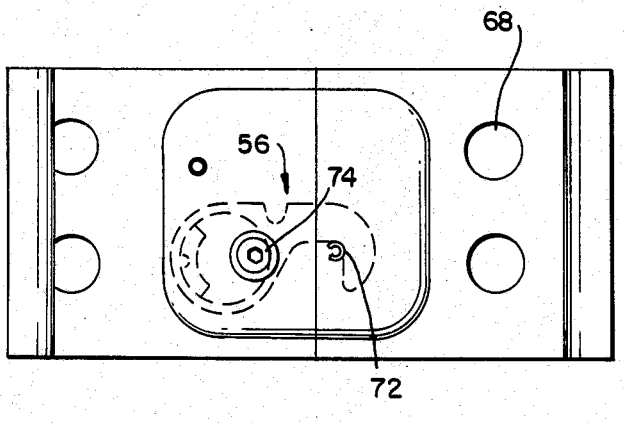
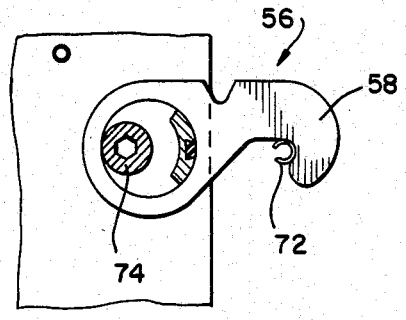
FIG 9

PREFABRICATED MODULAR BUILDING AND METHOD OF ASSEMBLY

BACKGROUND OF THE INVENTION

The disclosed invention relates to a prefabricated modular building which is formed from a plurality of interconnected lightweight laminated panels which are suspended from a central compression ring. The panels each have the shape of a segment of an oblate spheroid so that the completed building forms a dome. A plurality of similar buildings may be interconnected, even though the buildings are of dissimilar size, because each of the buildings has an extranceway and the entranceways are all of uniform height. Consequently, an inverted U-shaped passageway may be used to connect the buildings and to permit passage therebetween or the door jambs may be interconnected for the same reason.

The necessity of rapidly assembling habitable buildings frequently occurs due to disasters, either naturally occuring or manmade. Additionally, many remote areas are lacking in the materials necessary for constructing habitable space. Furthermore, the ability to transport conventional structures to these remote areas may be limited by a lack of usable roads. Consequently, it can be seen that a prefabricated modular building which is easily and quickly assembled from lightweight components suitable for withstanding harsh environments is desirable.

Hilsey, U.S. Pat. No. 4,290,246, discloses the use of precast concrete panels which may be assembled in a domed configuration. The structure of Hilsey is, however, heavy because it is manufactured of concrete and utilizes a subterranean foundation for support of the concrete panels. The concrete panels of Hilsey are difficult to transport and also require lifting means in order to assemble the panels. It can be seen, therefore, that the Hilsey panels are not suitable for emergency housing.

Moss, U.S. Pat. Nos. 4,744,205 and 3,562,975, disclose a prefabricated shelter and a method of erecting the same, but do not suggest a means for interconnecting shelters of dissimilar size. Additionally, the method of assembling the shelter is difficult due to the lack of any means for assuring the proper alignment of individual panels, and of interconnecting the panels.

Wagner, U.S. Pat. No. 2,278,956, discloses a building construction comprised of a plurality of interconnected panels. In FIG. 20, adjacent domes are interconnected but there is no provision for interconnecting adjacent dissimilarly sized domes. Additionally, there is no simple and quick method for connecting adjacent panels or means for properly positioning the panels relative to one another and in conformance with a compression ring.

It can be seen, therefore, that a prefabricated modular building assembly comprised of a plurality of easily interconnectable lightweight panels is desirable and advantageous. Such a building assembly must be relatively low cost and able to be manually assembled without complicated and/or expensive equipment and tools. The building assembly should be habitable in both warm and cold climes. Additionally, the building assembly should be expandable in order to provide more space when necessary and the expansion should be in discrete stages so as to minimize construction time. Preferably, expansion should be possible with building assemblies of dissimilar size.

OBJECTS AND SUMMARY OF THE INVENTION

The primary object of the disclosed invention is to provide a prefabricated modular building assembly which is constructed from a plurality of lightweight rigid insulating panels which are arcuate in two directions and which are suspended from a compression ring to positively align the panels together so that they may be interconnected.

An additional object of the disclosed invention is to provide a method of assembling a prefabricated building by means of suspending a plurality of lightweight rigid insulated panels from a compression ring so that adjacent panels are aligned and may be interconnected to thereby provide the building.

In summary, the disclosed invention provides a novel and unique building and method of assembly which permits a building structure to be quickly and easily manually constructed from a plurality of lightweight rigid insulating panels. The panels may be positioned as required without the need for lifting devices and the panels may be interconnected without the need for complicated tools, only an Allen wrench being necessary. Each of the panels has arcuate top, bottom and side edges in order to permit the panels to be assembled into a dome. A fastening mechanism pivotally extends from the top edge and is engagable with the compression ring for positively accurately aligning the top edge around the ring and thereby properly aligning each panel. Similar fastening means extend from the side edges of each panel and are engagable with the fastening means of the adjacent panels and cooperate with the fastening means of the top edge for thereby rigidly interconnecting the panels so as to provide the building assembly.

The building assembly may be expanded by interconnection with an adjacent building assembly, each of the building assemblies having a door panel with a doorway of uniform height, the doorways of adjacent buildings being joined together to permit passage between the buildings. The doorways are of uniform height even though the door panels are of dissimilar size, and the diameter of one dome exceeds the diameter of another. Additionally, a passageway may be used to connect adjacent doorways.

These and other objects and advantages and novel features of the present invention will become readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
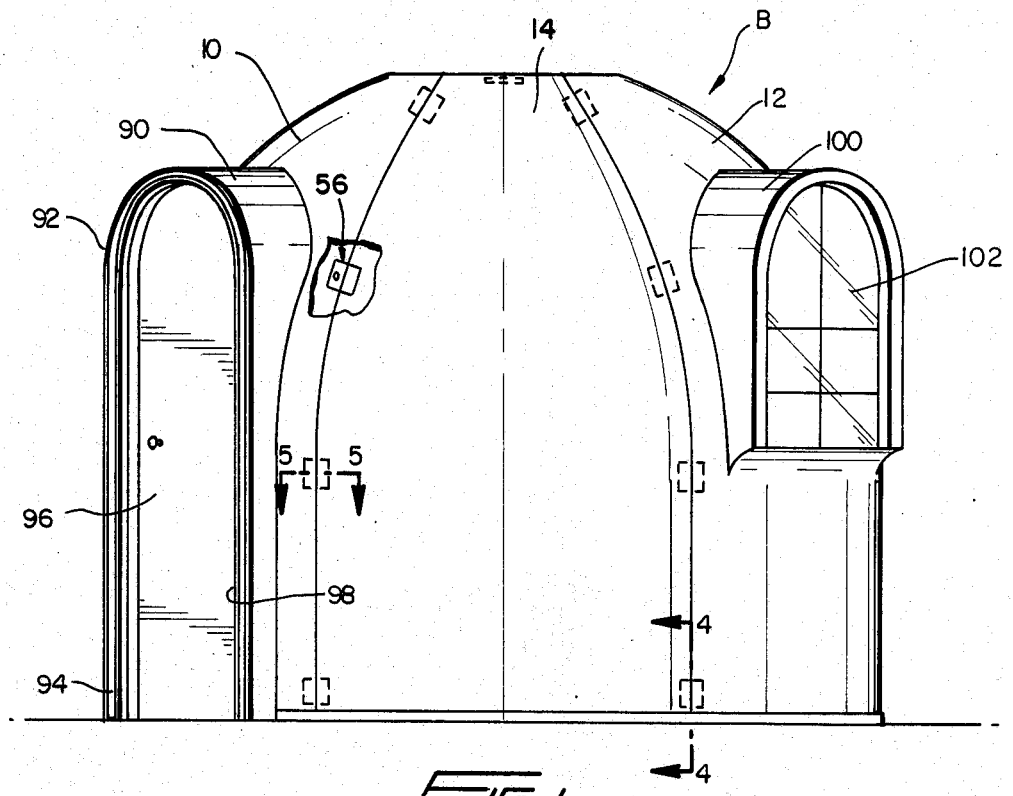
FIG. 1 is an elevational view with portions broken away of a building assembly of the invention.

As best shown in FIG. 1, building assembly B is comprised of a door panel 10, a window panel 12, and a plurality of side panels 14. The panels 10, 12 and 14 are interconnected so as to form the rigid self supporting building B by means of a plurality of compression connectors 56. Preferably, the connectors 56 are similar to those manufactured by Kason Hardware Corporation under U.S. Pat. Nos. 3,671,006 and 3,784,240. The disclosure of those patents is incorporated herein by reference.

Figure 3:
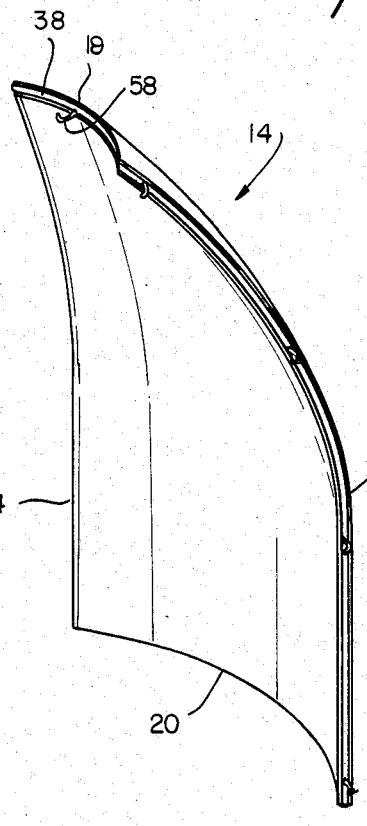
FIG. 3 is a perspective view of one of the panels of the invention.

It can be noted in FIG. 3 that side panel 14 has a curved top edge 18 and a correspondingly curved bottom edge 20. Panel 14 also has side edges 22 and 24 which curves in a direction different than that of edges 18 and 20. It can be noted in FIG. 3 that the side panel 14 is arcuate in two directions so that the panel 14 resembles a segment of an oblate spheroid. An oblate spheriod, as is well known, is a sphere which is flattened at the poles and this configuration is preferred because the assembled building B therefore has less dead airspace which must be ventilated and heated or cooled. While only the side panel 14 is shown in FIG. 3, the door panel 10 and the window panel 12 are identically sized and contoured to permit interconnection of the panels to provide the building B.

Each of the panels 10, 12 and 14 is comprised of an outer wall member or skin 26 and an inner wall member or skin 28. Preferably, an insulating core 30 is sandwiched between the wall members 26 and 28 to impart rigidity to the panels 26 and 28, as well as to serve a thermal and acoustic insulating function. Preferably, each of the wall members 26 and 28 is manufactured from fiber reinforced plastic or other similar lightweight material. The insulating core is, preferably, urethane foam. Urethane foam is preferred because the insulating properties thereof may be adjusted to meet the requirements of the user. It should be obvious, however, that additional insulating foams are known to those skilled in the art.

Figure 5:
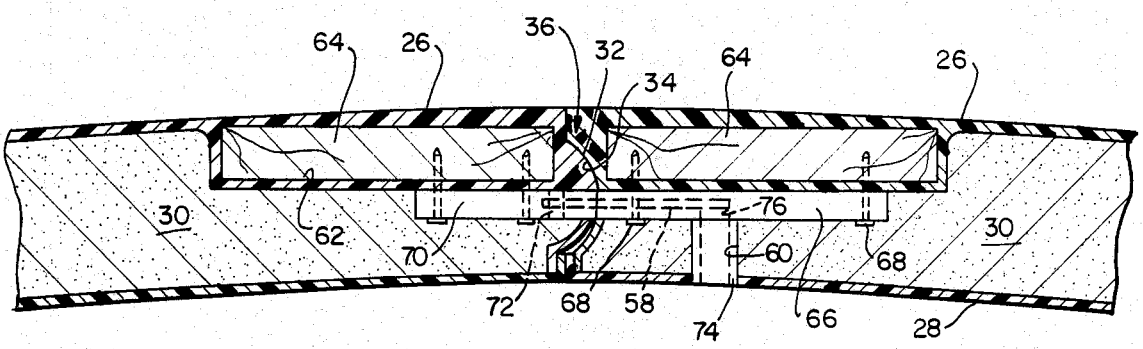
FIG. 5 is a fragmentary cross-sectional view taken along the section 5—5 of FIG. 1 viewed in to the direction of the arrows.

As best shown in FIG. 5, edge 22 includes a tongue 32 which is received and seated in the groove 34 of adjacent aligned side edge 24. The tongue 32 and groove 34 are coextensive with the length of the edges 22 and 24, respectively, and thereby permit the panels 10, 12 and 14 to be seated together and aligned. Additionally, the provision of a tongue and groove joint 36 provides a seal which minimizes the passage of air and moisture through the joint 36 into the building B.

Figure 2:
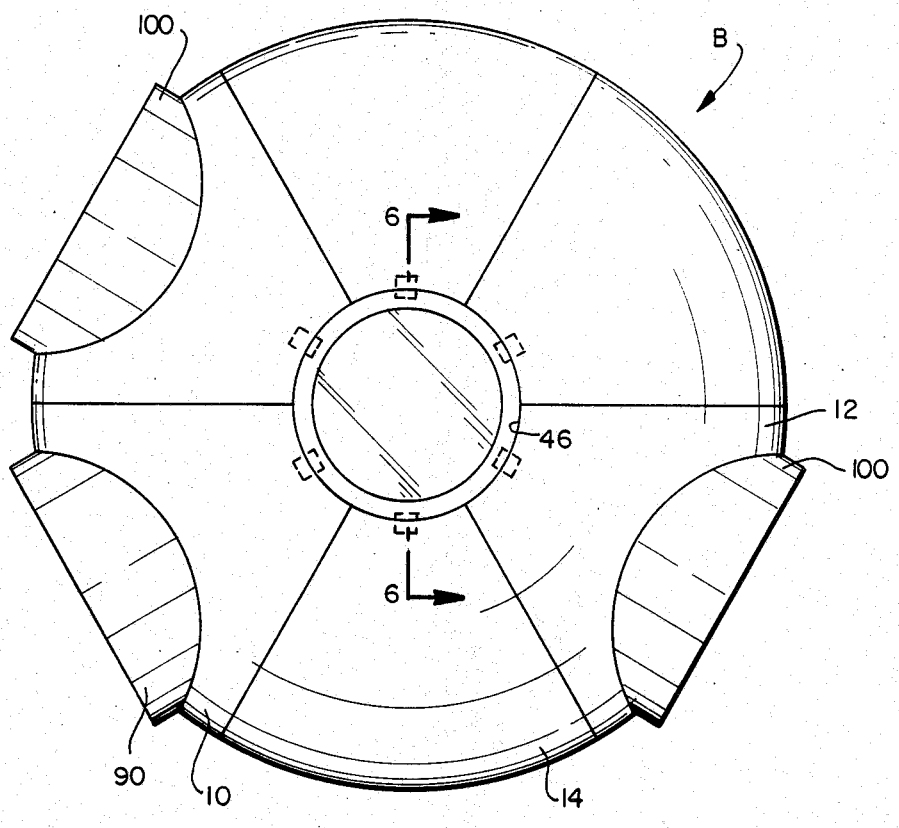
FIG. 2 is a top plan view thereof.
Figure 6:
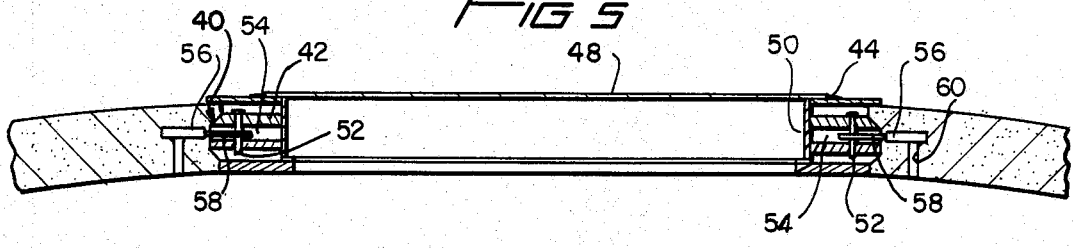
FIG. 6 is a fragmentary cross-sectional view taken along the section 6—6 of FIG. 2.

A groove 38 extends along each of top edges 18 of panels 10, 12 and 14 for receiving an annular tongue 40 of a compression ring 42, as best shown in FIG. 6. Preferably, a gasket 44 affixed to the periphery of compression ring 42 is in sealing engagement with the outer wall member 26 of the panels 10, 12 and 14 to weatherproof the compression ring 42 in circular aperture 46, as best shown in FIG. 2, and which is defined by the arcuate aligned top edges 18 of the assembled panels. The compression ring 42 has substantial diameter and is, preferably, manufactured from wood or other lightweight material. A skylight 48 spans the opening 50 of compression ring 42 for admitting light into the interior of building B. While the skylight 48 is shown in FIG. 6 to be flat, it should be obvious that a dome or skylight of other shape is usable with the invention.

Pins 52 are disposed in compression ring 42, as shown in FIG. 6, and extend generally transverse to skylight 48. A slot 54 extends transverse to the pins 52 outwardly to tongue 40. Connectors 56 extend outwardly from groove 38 of the top edges 18. Each of the connectors 56 is a hook assembly, such as those in the previously referenced U.S. Pat. Nos. 3,671,006 and 3,784,240, and each of the hook assemblies 56 includes a hook portion 58 which is pivotal between a release and an engage position. An opening 60 extends through inner wall member 28 and into core 30 to permit connection of a wrench with the hook 58 in order to cause pivoting thereof between the release and the engage position. In the engage position, the hook 58 engages with the pin 52 and causes the top edge 18 to be drawn towards the periphery of compression ring 42 and thereby accurately seats groove 38 on tongue 40 to align the panels 10, 12 and 14 about the compression ring 42. While only two pins 52 and slots 54 are disclosed in FIG. 6, FIG. 2 makes clear that the top edge 18 of each panel 10, 12 and 14 has a hook assembly 56 extendable therefrom so as to engage a pin 52 positioned around the ring 42.

As best shown in FIG. 5, outer wall members 26 each include a pocket 62 in which a block of wood 64 is received. The male half 66 of the hook assembly 56 is secured by nails 68, or the like, to one of the blocks of wood 64 while the female half 70 of the hook assembly 56 is likewise secured by nails 68 to its block of wood 64. The use of pockets 62 for receiving the blocks 64 is preferred because of the strength provided by the pockets 62. The pockets are integral with outer wall 26 and are therefore of reinforced material. The pockets 62 can therefore withstand the forces and stresses exerted by the hook 58 when drawing the pin 72 into engagement. Naturally, these forces can be quite high if the edges are misaligned to any appreciable extent. It should be noted in FIGS. 5 and 6 that the female half 70 of the hook assembly 56 is normally only utilized with the side edges 22 and 24 and that the pin 52 is used with the top edges 18 in order to minimize the ease with which the compression ring 42 may be manufactured. It should be obvious, however, that female half 70 could also be used with ring 42. The female half 70 includes a pin 72 which receives the hook 58 of the male half 66. The opening 60 may include insert 74 in order to prevent the urethane foam 30 from filling the opening 76 in the male half 60 which is used to access the hook 58 and to cause the pivoting thereof. It should be obvious that the pivoting of the hook 58 of the male half 66 causes the hook 58 to engage the pin 72 and to thereby pull the tongue 32 and the groove 34 together to interconnect the panels 10, 12 and 14.

Figure 4:
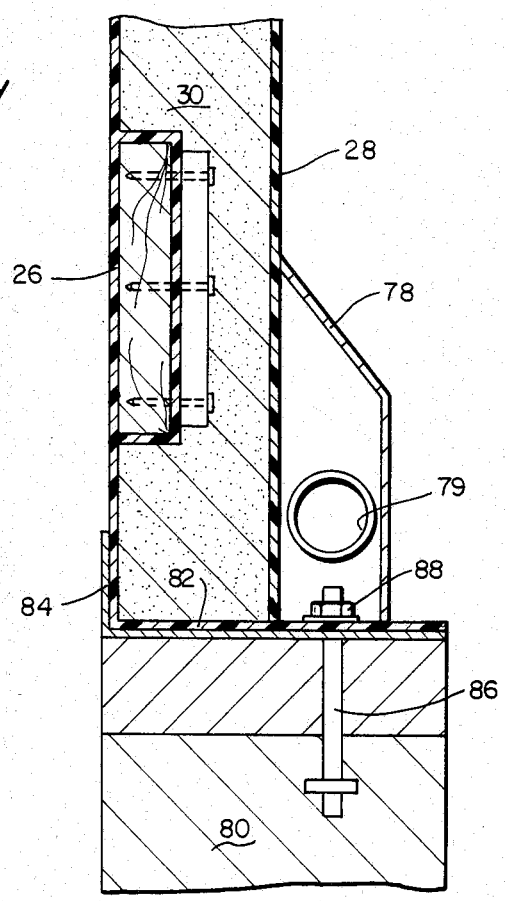
FIG. 4 is a fragmentary cross-sectional view taken along the section 4—4 of FIG. 1 viewed in the direction of the arrows.

As best shown in FIG. 4, a combination reinforcing rib and baseboard 78 extends from the lower portion of inner wall member 28 into the interior of building B and adds support and stability to the panels 10, 12 and 14 when resting on the foundation 80. An electrical conduit 79 is positioned in the space between wall panels 28 and baseboard 78. Preferably, outer wall member 26 includes a bottom flange portion 82 which extends inwardly beyond reinforcing rib 78. A weather strip 84 may be seated on the foundation 80 to receive bottom flange 82 and to thereby prevent moisture from entering the building B. Similar flanges extend around the top edge 18 and the side edges 22 and 24 so as to insure that the insulating core 30 does not become wet or otherwise damaged by the atmosphere. The flange 82 and the reinforcing rib 78 are bolted by bolts 86 and nuts 88 to the foundation 80 and therewith further insure the structural stability of the building B with its interconnected panels 10, 12 and 14.

As best shown in FIG. 1, door panel 10 includes an integral accessway 90 of arch shape extending outwardly therefrom. The access way 90 conforms to the contour of outer wall member 26 and has a vertical outer edge 92. Outer edge 92 preferably includes a groove 94, for reasons to be explained herein later. Door 96 covers opening 98 in accessway 90 in a well known manner. The opening 98 is aligned with a corresponding opening in outer wall member 26 and the opening 98 extends a predetermined distance above lower edge 20, for reasons to be explained later.

Window panel 12 includes window support frame 100 of arch shape in which window assembly 102 is received.

It can be noted in FIG. 2 that the building B is comprised of a single door panel 10, two window panels 12 and three side panels 14. It should be obvious that the building B may be fabricated from any combination of door panels 10, window panels 12 and side panels 14 as may be required. The only requirement is that a sufficient number of panels 10, 12 and 14 is chosen so that the compression ring 42 is totally encircled by the panels 10, 12 and 14 and obviously, the number of panels required will be a function of the diameter of ring 42. Obviously, at least one door panel 10 must be included in order that the building B may be accessed.

Figure 7:
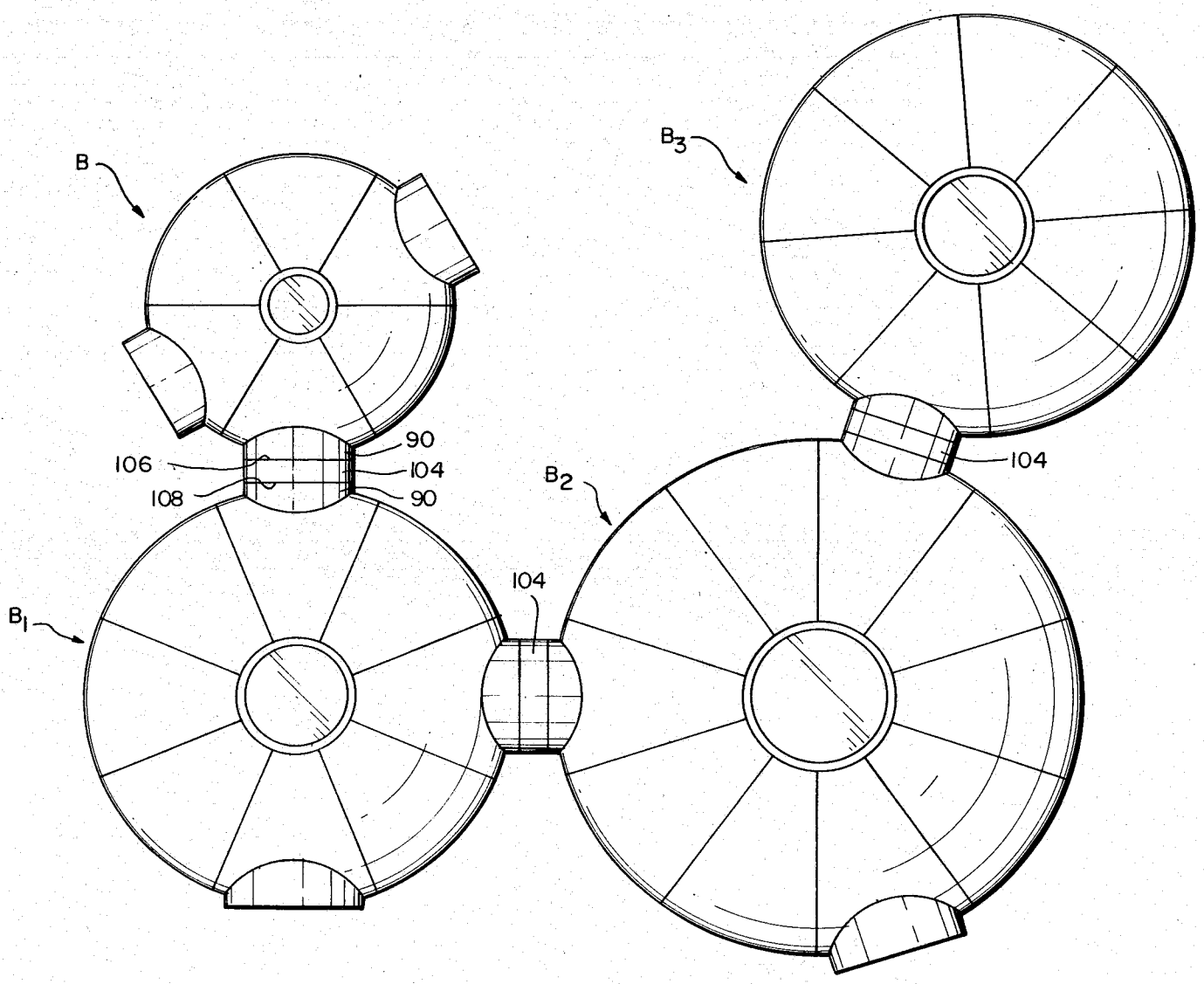
FIG. 7 is a top plan view of several interconnected building assemblies of the invention; and, FIG. 8 is a fragmentary side view of the complementary fasteners interconnected with portions broken away for clarity; and, FIG. 9 is a cross-sectional view of the cam illustrating the movement of the hook upon rotation of the cam to draw the hook and pin fasteners together.

As best shown in FIG. 7, building B is interconnected to building B1 which is likewise interconnected with a building B2 which is interconnected to a building B3. A passageway connector 104 is connected to each of accessways 90. The passageway connector 104 is of inverted U-shaped configuration. The passageway connector 104 has side edges 106 and 108, each of which includes a tongue which is received within the groove 94 in the outer edge 92 of each of the accessways 90. The passageway connector 104 is similar in construction to the panels 10, 12 and 14 and is therefore of lightweight configuration and may be readily transported.

It can be noted in FIG. 7 that the buildings B, B1, B2 and B3 are each of a different size or diameter and yet, the buildings are interconnected by means of passageway connectors 104. The passageway connectors 104 are each of identical size and configuration and are able to connect with adjacent accessways 90 because the accessways 90 are also of identical size and configuration. The provision of identically sized and configured acccessways 90 permits this interconnection of buildings B, B1, B2 and B3 and thereby permits expansion of the usable space of the individual buildings B, B1, B2 and B3 and also permits passage therebetween.

ASSEMBLY OF BUILDING B

The assembly of building B, or for that matter, buildings B1, B2 and B3, is easily and quickly accomplished because of the utilization of the compression ring 42 which positively aligns and positions the top edges 18 and thereby the side edges 22 and 24. The compression ring 42 cooperates with the hook assemblies 56 disposed along the side edges 22 and 24 to thereby provide a rigid assembly of interconnected panels 10, 12 and 14.

A first one of the panels 10, 12 and 14 is positioned adjacent compression ring 42 so that the hook portion 58 of the hook assembly 56 is adjacent one of the pins 52. The hook 58 is then pivoted from the release to the engage position with the result that the hook 58 engages the adjacent pin 52 and thereby positions the groove 38 of the top edge 18 along the tongue 40 of the compression ring 42. The hook 58 of the hook assembly 56 therefore positively aligns the top edge 18 around the compression ring 42 and simultaneously positively positions and aligns the side edges 22 and 24 because of the tight fit of the tongue 40 with the groove 38. Another one of the panels 10, 12 and 14 is then positioned so that the hook 58 of the top edge 18 is disposed adjacent one of the pins 52 adjacent the already engaged pin 52. The second hook 58 is similarly pivoted so as to positively seat and align the top edge 18 around the compression ring 42. The seating of the second one of the panels 10, 12 and 14 causes one of the edges 22 or 24 thereof to be positioned adjacent the edge 22 or 24 of the first one of the panels 10, 12 and 14 and thereby causes the tongue 32 to be seated in the groove 34. Consequently, the tongue and groove joint 36 facilitates the positioning of the panels 10, 12 and 14.

Seating of the tongue 32 in the groove 34 causes the male halves 66 of the hook assemblies 56 to be positioned adjacent the female halves 70. Pivoting of the hook 58 can therefore be readily accomplished with the result that the hooks 58 engage with the pins 72 and thereby interconnect the adjacent panels. Pivoting of the hooks 58 from the release to the engage position is performed in cooperation with the connectors 56 of the top edges 18 to thereby rigidly interconnect the panels 10, 12 and 14 with the compression ring 42 so as to provide a rigid building assembly B.

It should be obvious that the above procedure is repeated until the compression ring 42 is encircled by the panels 10, 12 and 14. The cooperation of the hook assemblies 56 of the side edges 22 and 24 with the hook assembly 56 of the top edge 18 results in a very rigid building assembly B which is self supporting, particularly when the panels 10, 12 and 14 are connected to the foundation 80.

Adjacent building assemblies B or B1, B2 and B3 can be readily interconnected by the positioning of the passageway connectors 104 into engagement with the accessways 90. The tongues extending outwardly from the side edges 106 and 108 of the passageway connectors 104 are readily received in the grooves 94 of the accessways 90 and thereby interconnect the adjacent building assemblies. It should be obvious that it is merely necessary that only a first building B be assembled initially and that the adjacent building assembly can be assembled as necessary by the user. Because of the uniform height of the accessways 90, the user is assured that he may select and assemble a subsequent building assembly without fear that the building assemblies will not be able to be interconnected or will require costly construction in order to be interconnected.

While this invention has been described as having a preferred design, it is understood that it is capable of further modifications, uses and/or adaptations of the invention following in general the principal of the invention and including such departures from the present disclosure as come within known or customary practice in the art to which the invention pertains, and as may be applied to the central features hereinbefore set forth, and falls within the scope of the invention of the limits of the appended claims.

What I claim is:

1. A prefabricated modular building assembly, comprising:
(a) circular ring means of substantial diameter;
(b) a plurality of lightweight contoured panels, each of said panels having arcuate top, bottom and side edges providing panels of identical size and contour;
(c) said top edges conforming to said ring means;
(d) means associated with each of said top edges cooperatively engaged with said ring means for positively securing said top edges and thereby said panels around said ring means;
(e) one of the side edges of each panel including a tongue and the other side edge including a conforming groove; and,
(f) compression securement means extending from the side edges of each panel, the securement means of adjacent panels interengaged and drawing said panels together so that the tongue of a panel is seated in and sealed by the groove of the adjacent panel for thereby rigidly interconnecting said panels and providing a self-supporting building assembly.

2. The assembly as defined in claim 1, wherein:
(a) each of said panels defines a segment of an oblate spheriod.

3. The assembly as defined in claim 1, wherein:
(a) one of said panels has an opening therethrough extending a predetermined distance upwardly from said bottom edge for thereby providing an accessway.

4. The assembly as defined in claim 3, further comprising:
(a) a second building assembly comprised of a plurality of lightweight contoured interconnected panels suspended from a compression ring means;
(b) one of said panels of said second building assembly having an opening therethrough extending upwardly a distance substantially equal to the distance which said first mentioned opening extends; and,
(c) passageway means connected to said first mentioned building assembly and said second building assembly extending between said openings for thereby permitting access to the interior of said building assemblies.

5. The assembly as defined in claim 4, wherein:
(a) said first mentioned ring means having a diameter exceeding the diameter of said second mentioned ring means.

6. The assembly as defined in claim 1, wherein:
(a) a continuous groove being disposed along each of said top edges; and,
(b) gasket means being connected to said ring means whereby said gasket means is received in and sealed to said groove for thereby sealing compression ring means with said top edges.

7. The assembly as defined in claim 1, wherein:
(a) said ring means having a peripheral tongue; and,
(b) each of said top edges having a continuous groove adapted for receiving said tongue for thereby seating each of said top edges with said ring means.

8. The assembly as defined in claim 1, wherein:
(a) said securement means including first and second connectors and said first connector including a pin; and,
(b) said second connectors includes a hook assembly having a hook portion thereof adapted for pivoting between an engaged and a release position whereby pivoting of said hook portion from said release to said engaged position causes said hook portion to engage said pin and to thereby draw the adjacent side edges together.

9. The assembly as defined in claim 8, wherein:
(a) each of said panels including and outer wall member and an inner core member secured thereto.

10. The assembly as defined in claim 9, wherein:
(a) an inner wall member secured to said insulating core member; and,
(b) means extending through said inner wall member permitting connection with said hook assemblies in order to permit pivoting of said hook portion between said positions.

11. The assembly as defined in claim 9, wherein:
(a) said outer wall member includes a plurality of pockets extending into said core means; and,
(b) each of said first and second connectors is disposed in one of said pockets.

12. The assembly as defined in claim 1, wherein:
(a) foundation means disposed beneath said building assembly; and,
(b) each of said panels secured to said foundation means.

13. The assembly of claim 8, wherein:
(a) said hook assembly being associated with the side edge of each panel having said groove; and,
(b) said hook portions extending laterally through the associated groove.

14. The assembly of claim 13, wherein:
(a) said pins extending transverse to the associated hook portions.

15. The assembly of claim 10, wherein:
(a) said inner and outer wall members being comprised of fiber reinforced plastic; and,
(b) said insulating core member being comprised of a foam.

16. The assembly of claim 1, wherein:
(a) said ring means including a skylight assembly.

17. A prefabricated modular building assembly, comprising:
(a) a plurality of lightweight contoured panels interconnected for defining a bounded space;
(b) each of said panels having arcuate top, bottom and side edges whereby each of said panels provides an identically sized and contoured segment of an oblate spheriod;
(c) each of said side edges includes tongue and groove joint means, the joint means of adjacent panels cooperate for positioning said panels with respect to each other;
(d) compression securement means extending from each side edge of a panel, the securement means of adjacent panels interengaged and drawing the panels together for securing said panels so that the cooperating tongue and grooves seal;
(e) said top edges cooperate and define a circular opening of substantial diameter;
(f) fastening means associated with the top edge of each of said panels; and,
(g) ring means cooperatively engaged with the fastening means of each of said panels for positively accurately positioning and aligning said panels and cooperating with said securement means for thereby providing a rigid structure.

18. The assembly as defined in claim 17, wherein:

(a) said fastening means including first and second connectors and said first connectors including a plurality of pin means disposed along one side edge of each panel; and, (b) said second connectors including a hook portion pivotal between an engage and a release position whereby pivoting of said hook portion between said release and said engage position causes said hook portion to engage and associate one of said pins and to thereby draw the side edge towards the adjacent side edge and to seat the tongue in the cooperating groove.

19. The assembly as defined in claim 18, wherein:

(a) each of said panels includes an inner and an outer wall member and an insulating core member disposed therebetween;

(b) each of said fastening means is secured to said outer wall member; and, (c) each of said inner wall members includes means permitting association with said fastening means for thereby causing said hook portion to be pivoted.

20. The assembly as defined in claim 18, wherein:

(a) each of said top edges has a continuous groove;

(b) said ring means includes a continuous peripheral tongue; and, (c) gasket means associated with said ring means sealing with said top edge whereby said tongue is positioned in said groove while said gasket means is positioned into sealing relation with said top edge for thereby sealing said ring means with said top edge.

21. The assembly as defined in claim 17, further comprising:

(a) a second rigid structure comprised of a plurality of identically sized and contoured interconnected panels suspended from a ring means and said second rigid structure disposed adjacent said first mentioned rigid structure;

(b) one of said panels of each of said structures has an opening therethrough extending a preselected distance upwardly from said bottom edge and each of said openings extending upwardly an equal distance; and, (c) passageway means connected to each of said structures extending between said openings for permitting passage therebetween.

22. The assembly as defined in claim 21, wherein:

(a) one of said structures has a diameter exceeding the diameter of the other of said structures.

23. The assembly as defined in claim 21, wherein:

(a) a foundation is disposed below and supports each of said structures; and, (b) each of said panels of each of said structures is secured to the foundation.

* * * * *